US010270152B2

(12) United States Patent
Phillips et al.

(10) Patent No.: US 10,270,152 B2
(45) Date of Patent: Apr. 23, 2019

(54) BROADBAND TRANSCEIVER AND DISTRIBUTED ANTENNA SYSTEM UTILIZING SAME

(75) Inventors: Fred William Phillips, Forest, VA (US); Thomas Kummetz, Forest, VA (US); Narian Izzat, Aylesford (GB)

(73) Assignee: CommScope Technologies LLC, Hickory, NC (US)

( * ) Notice: Subject to any disclaimer, the term of this patent is extended or adjusted under 35 U.S.C. 154(b) by 993 days.

(21) Appl. No.: 12/873,742

(22) Filed: Sep. 1, 2010

(65) Prior Publication Data

US 2011/0243201 A1 Oct. 6, 2011

Related U.S. Application Data

(60) Provisional application No. 61/319,643, filed on Mar. 31, 2010.

(51) Int. Cl.

| | |
|---|---|
| ***H01Q 1/00*** | (2006.01) |
| ***H01Q 1/52*** | (2006.01) |
| ***H01Q 21/28*** | (2006.01) |
| ***H01Q 21/30*** | (2006.01) |

(52) U.S. Cl.

CPC ..... *H01Q 1/007* (2013.01); *H01Q 1/525* (2013.01); *H01Q 21/28* (2013.01); *H01Q 21/30* (2013.01)

(58) Field of Classification Search

CPC ..... H01Q 1/007; H01Q 1/525; H01Q 21/28; H01Q 21/30

See application file for complete search history.

(56) References Cited

U.S. PATENT DOCUMENTS

| | | | | |
|---|---|---|---|---|
| 2,270,965 | A | 1/1942 | Peterson | |
| 3,739,392 | A | 6/1973 | Ross et al. | |
| 4,223,310 | A * | 9/1980 | Davidson | H01Q 25/00 340/7.25 |
| 4,916,460 | A | 4/1990 | Powell | |
| 4,941,200 | A | 7/1990 | Leslie et al. | |

(Continued)

FOREIGN PATENT DOCUMENTS

| | | |
|---|---|---|
| EP | 1448008 | 8/2004 |
| FR | 2650442 | 2/1991 |

(Continued)

OTHER PUBLICATIONS

Thirteen-page International Search Report and Written Opinion dated Jul. 22, 2011 for U.S. PCT case No. PCT/US2011/29540.

(Continued)

*Primary Examiner* — Zhiyu Lu
(74) *Attorney, Agent, or Firm* — Fogg & Powers LLC

(57) ABSTRACT

A broadband transceiver includes at least one layer structure that is substantially impermeable to RF radiation. The layer structure includes a first face surface substantially opposite a second face surface. A receive antenna is located proximate the first face surface and configured to receive RF transmissions. A transmit antenna is located proximate the second surface and configured to transmit RF transmissions. At least one of the receive and transmit antennas generates a generally toroidal radiation pattern that is stronger in a direction substantially parallel to the respective layer structure face surface compared to a direction substantially perpendicular to the face surface.

48 Claims, 12 Drawing Sheets

(56) References Cited

U.S. PATENT DOCUMENTS

| | | | | |
|---|---|---|---|---|
| 5,373,297 | A | 12/1994 | Briguglio | |
| 5,697,063 | A | 12/1997 | Kishigami et al. | |
| 6,195,561 | B1 | 2/2001 | Rose | |
| 6,381,473 | B1 | 4/2002 | Niki | |
| 6,501,942 | B1 | 12/2002 | Wiessman | |
| 6,731,904 | B1 | 5/2004 | Judd | |
| 6,801,767 | B1 | 10/2004 | Schwartz et al. | |
| 6,900,775 | B2 | 5/2005 | Shapira | |
| 6,937,879 | B2 | 8/2005 | Mesecher | |
| 7,394,883 | B2 | 7/2008 | Funakubo | |
| 2002/0149534 | A1 | 10/2002 | Bobier | |
| 2002/0191565 | A1 | 12/2002 | Main et al. | |
| 2002/0193146 | A1 | 12/2002 | Wallace | |
| 2004/0047335 | A1 | 3/2004 | Proctor, Jr. | |
| 2004/0110469 | A1* | 6/2004 | Judd et al. | 455/15 |
| 2004/0263260 | A1* | 12/2004 | Ravi et al. | 331/16 |
| 2005/0239417 | A1* | 10/2005 | Boos | 455/86 |
| 2006/0035607 | A1* | 2/2006 | Hayes et al. | 455/117 |
| 2007/0002797 | A1* | 1/2007 | Lai | H04W 36/06 370/331 |
| 2007/0222697 | A1* | 9/2007 | Caimi et al. | 343/861 |
| 2008/0181171 | A1 | 7/2008 | Kozly et al. | |
| 2008/0225775 | A1* | 9/2008 | Proctor et al. | 370/315 |
| 2008/0232305 | A1 | 9/2008 | Oren et al. | |
| 2009/0195468 | A1* | 8/2009 | Croman | 343/767 |
| 2009/0252094 | A1 | 10/2009 | Chang | |
| 2009/0307739 | A1 | 12/2009 | Dean | |
| 2010/0150060 | A1* | 6/2010 | Vitek | 370/328 |
| 2017/0264014 | A1* | 9/2017 | Le-Ngoc | H01Q 21/24 |

FOREIGN PATENT DOCUMENTS

| | | |
|---|---|---|
| GB | 2390225 | 12/2003 |
| WO | WO1998029922 | 7/1998 |
| WO | WO1999044297 | 9/1999 |
| WO | WO2002039541 | 5/2002 |
| WO | WO2006028447 | 3/2006 |
| WO | WO2009101417 | 8/2009 |
| WO | WO2009138876 | 11/2009 |

OTHER PUBLICATIONS

Four-page Publication; Youngki Lee, et al.; A Compact On-Frequency Indoor Repeater Antenna With High Isolation for WCDMA Applications; vol. E92B, No. 12; pp. 3964-3967; published Dec. 1, 2009.

* cited by examiner

BROADBAND TRANSCEIVER AND DISTRIBUTED ANTENNA SYSTEM UTILIZING SAME

CROSS-REFERENCE TO RELATED APPLICATIONS

This Application claims priority from U.S. Provisional Patent Application Ser. No. 61/319,643 filed Mar. 31, 2010, and entitled "Non-Duplexer Broadband DAS Remote," the disclosure of which is incorporated herein by reference in its entirety.

FIELD OF THE INVENTION

The present invention relates generally to wireless transceiver systems and particularly to such systems for use in repeaters or distributed antenna systems.

BACKGROUND OF THE INVENTION

In existing wireless technologies, signal repeating devices, such as repeaters or distributed antenna systems (DAS), are used to extend the coverage of an overall wireless system beyond the range of traditional base stations. For example, an overall cellular or wireless communication system may consist of a plurality of base transceiver stations (BTS) or base stations that communicate with each other and with user equipment, such as cellular phones, to provide a defined coverage area. In such coverage areas, there are often smaller geographical areas that have very low signal coverage, as provided by one or more of the base stations. For example, such areas of low signal coverage may be within buildings or in areas that are otherwise obstructed, such as by terrain features or man-made structures. Rather than simply implementing another costly and large base station to provide coverage in such low signal areas, repeaters and distributed antenna systems are often utilized.

Within buildings, a DAS system might incorporate one or more master units that receive downlink signals from one or more donor base stations and then distribute those signals via fiber optic or copper cable throughout the building. Waveguides or free-space laser links might be used as well. At designated points in the building, remote units coupled with the master unit(s) then amplify the downlink signals and connect them to radiating antennas. At those same points, uplink signals received from mobile users may be amplified, filtered, and sent back through the distribution system where they are summed together and transmitted back to the donor base station. At the remote units, the transmit (downlink) and receive (uplink) signals are usually combined onto a single antenna using a duplexer. The key function of the duplexer is to provide isolation between the transmitter or downlink signals and the receiver and uplink signals while connecting those devices and signal paths to a single antenna. Isolation between the transmitter and receiver is desirable to protect the sensitive receiver circuitry from the higher power transmit signals produced by the transmitter.

There are drawbacks, however, in using a duplexer to do such signal combining. First, duplexers are large devices and are expensive. Second, duplexers achieve their isolation by using fixed filters tuned to the specific frequencies that are sharing the antenna. For example, a duplexer includes two fixed tuned RF filters that are joined at one end for connection to a single antenna. One filter is tuned to the receive or uplink frequencies and the other is tuned to the transmit or downlink frequencies. Therefore, the remote units using such duplexers are frequency limited.

To be cost effective and flexible a DAS system remote unit needs to cover a wide range of frequencies, such as from about 400 MHz to about 5,000 MHz. The allocation of these frequencies into bands may change over time and are typically different in different countries. Fixed tuned duplexers provide little or no flexibility. For example, covering several bands may require several expensive and bulky duplexers and a switch matrix to select the proper duplexer for a given band. To build a low cost remote unit for such a system, a solution that does not require a duplexer is desired.

Embodiments of the present invention address the drawbacks in the prior art as discussed further below, and provide a significant advantage over a duplexer based system wherein the remote unit can only cover a single band, such as approximately an 824 MHz to 894 MHz band.

SUMMARY OF THE INVENTION

In accordance with one embodiment of the invention, a broadband transceiver that may be suitable for use as a remote unit within a distributed antenna system (DAS) or as a remote radio head coupled to one or more base transceiver stations (BTS) includes at least one layer structure that is substantially impermeable to RF radiation. The layer structure might act as a housing for the electronics of the transceiver. The layer structure includes a first face surface substantially opposite a second face surface. A receive antenna is located on, above, or proximate the first face surface and configured to receive RF transmissions, and a transmit antenna is located on, above, or proximate the second face surface and configured to transmit RF transmissions. The first and second face surfaces may be planar or non-planar (such as curved, wavy, or cone-shaped) as long as the first and second face surfaces are electrically isolated. At least one of the receive and transmit antennas generates a generally toroidal radiation pattern that is stronger in a direction substantially parallel to the respective layer structure face surface compared to a direction substantially perpendicular to the face surface. In one embodiment, both the receive and transmit antennas generate a generally toroidal radiation pattern that is stronger in a direction substantially parallel to the respective layer structure face surface compared to a direction substantially perpendicular to the face surface.

One embodiment of the broadband transceiver includes a digital signal processor configured to interface with a device and appropriate transmitter and receive circuits that include appropriate digital to analog circuitry, frequency conversion circuitry and amplifiers for processing the transmit and receive signals. The transceiver, in the form of a remote unit of a DAS system, might communicate with a master unit over an interface that might include an optical fiber interface, a waveguide, an electrical cable interface, a free-space laser link and combinations thereof. In one embodiment, at least one of the receive antenna and the transmit antenna is a broadband monopole antenna. The broadband transceiver is mounted so that the RF impermeable layer structure is oriented in a space, such as a room or some other space, in a substantially horizontal orientation for at least one of the receive and transmit antennas to generate the generally toroidal radiation pattern that is stronger in the horizontal direction compared to a vertical direction. For example, the transceiver is mounted in a space having a ceiling surface and a floor surface and the RF impermeable layer structure is elevated and oriented such that the first face surface with the receive antenna is spaced from and facing the ceiling surface and the second face surface with the transmit antenna spaced from and facing the floor surface.

For isolation, the receive antenna is positioned on the RF impermeable layer structure above the transmit antenna. Alternatively, the transmit antenna might be positioned above the receive antenna. In an alternative embodiment, a plurality of receive antennas and/or a plurality of transmit antennas might be located on the respective face surfaces of the transceiver or layer structure. For further isolation between the antennas the layer structure includes an RF choke positioned on the layer structure between the opposing face surfaces. The structure might include at least one high impedance surface that resists propagation of surface waves. For example, the high impedance surface might include a rough layer, a coating layer of a high impedance material or an adhered layer of a high impedance material or a combination of same.

In some embodiments, the broadband transceiver is capable of communicating with mobile user equipment using frequencies greater than or equal to approximately 400 MHz and less than or equal to approximately 2.7 GHz.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Embodiments of the invention provide a broadband transceiver, such as for use with a distributed antenna system (DAS) that does not employ the use of a duplexer. To provide the isolation needed between the transmitter and receiver, embodiments of the invention employ using two antennas, one for transmit and one for receive. Embodiments of the invention also provide the needed isolation between the two antennas while still providing the required antenna coverage for transceiver or any remote units of a DAS.

Figure 1:
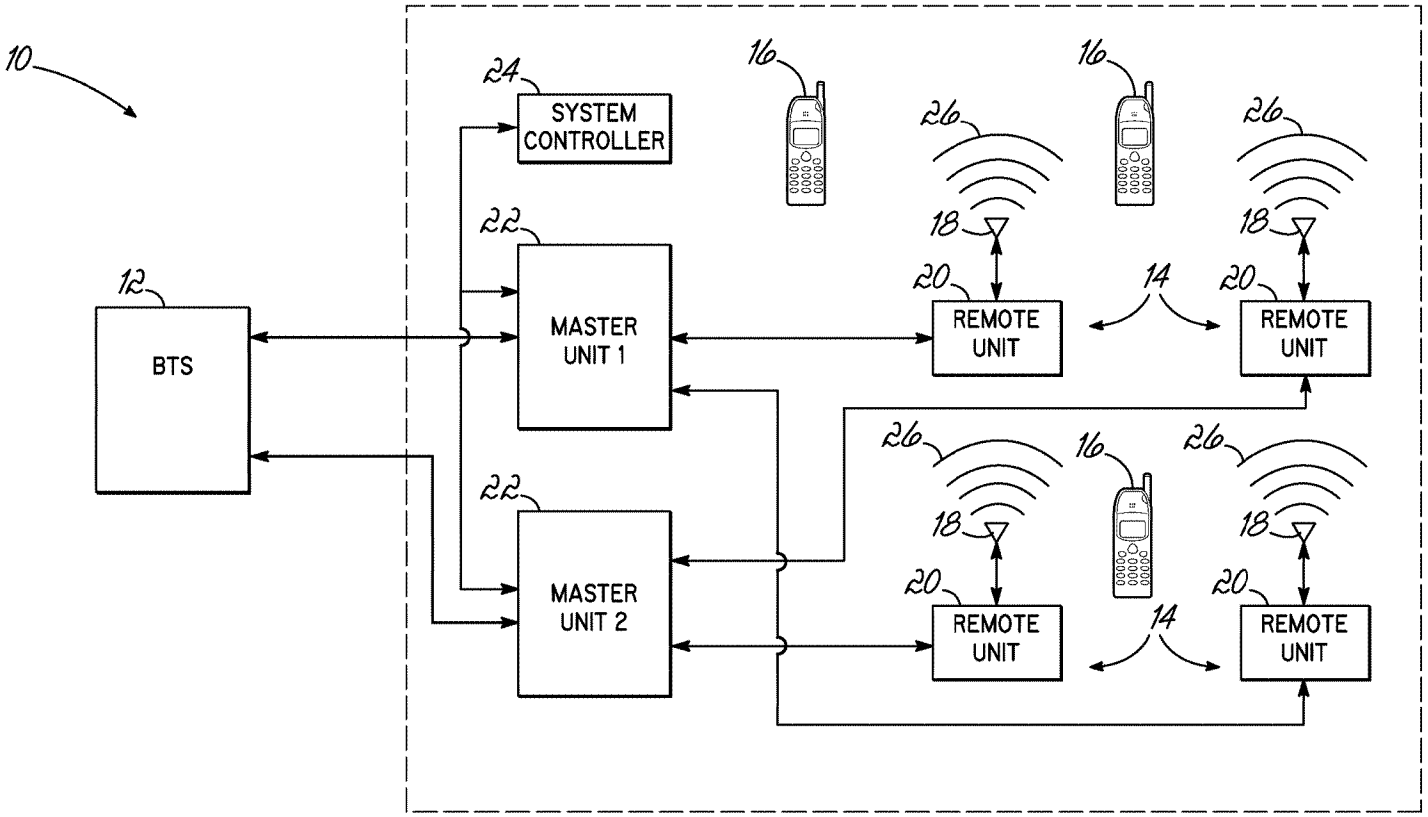
FIG. 1 is schematic diagram of a distributed antenna system for implementing embodiments of the invention.

FIG. 1 illustrates an exemplary signal repeating system that may incorporate embodiments of the invention. Specifically, FIG. 1 illustrates a schematic diagram for an exemplary distributed antenna system (DAS) 10. The DAS 10 may be appropriately coupled to at least one base station (BTS), such as BTS 12 in a wired or wireless fashion. The DAS 10 might be incorporated into an area, such as a building environment, and thus, includes a number of remote antenna units 14 that are distributed in the environment to provide coverage within a service area of the DAS 10. In that way, the remote antenna units 14 service a number of different user equipment (UE) devices 16, such as cellular phones, operating in the environment of the DAS 10. Generally, each remote antenna unit 14 typically includes at least one antenna 18 and suitable electronics 20. Antennas 18 may also be reflective of one or more antennas in each remote unit 14.

Figure 1A:
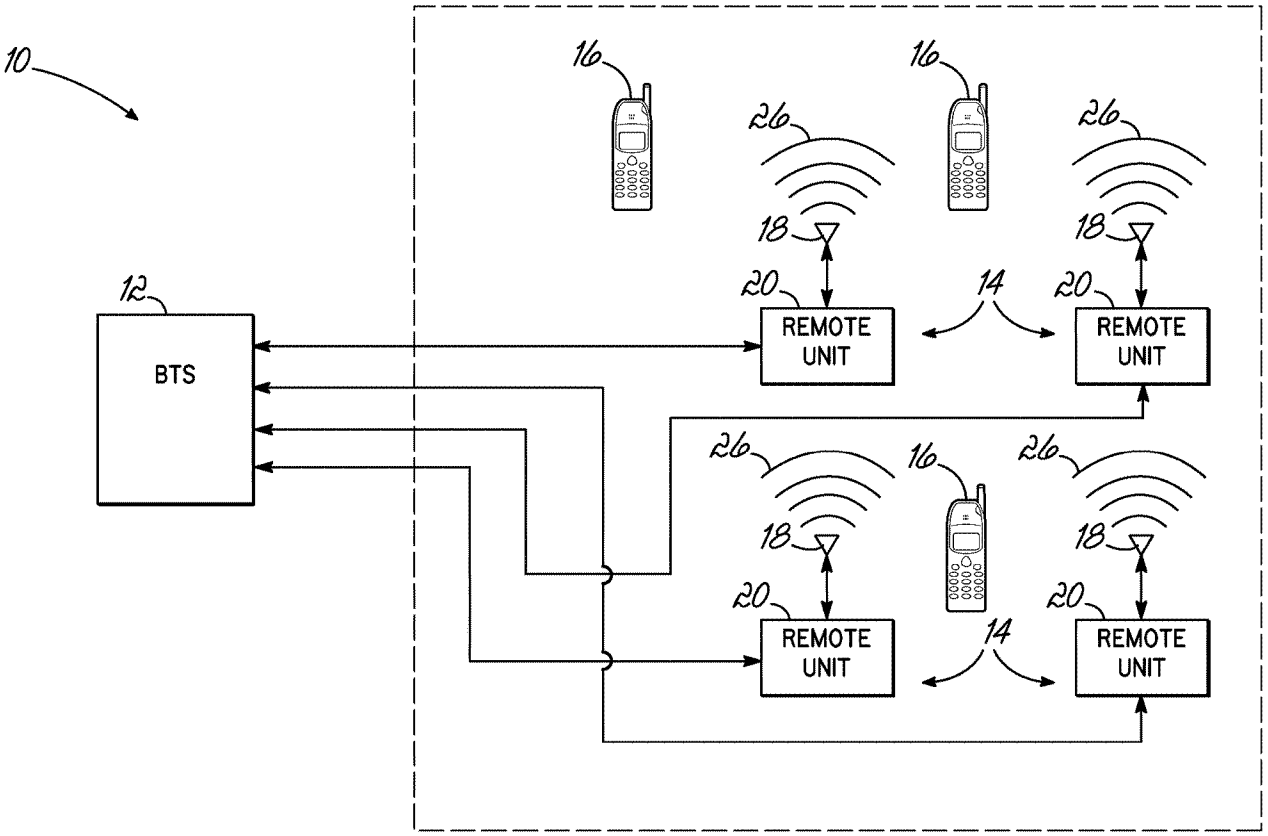
FIG. 1A is a schematic diagram of a remote radio head configuration for implementing embodiments of the invention.
Figure 2:
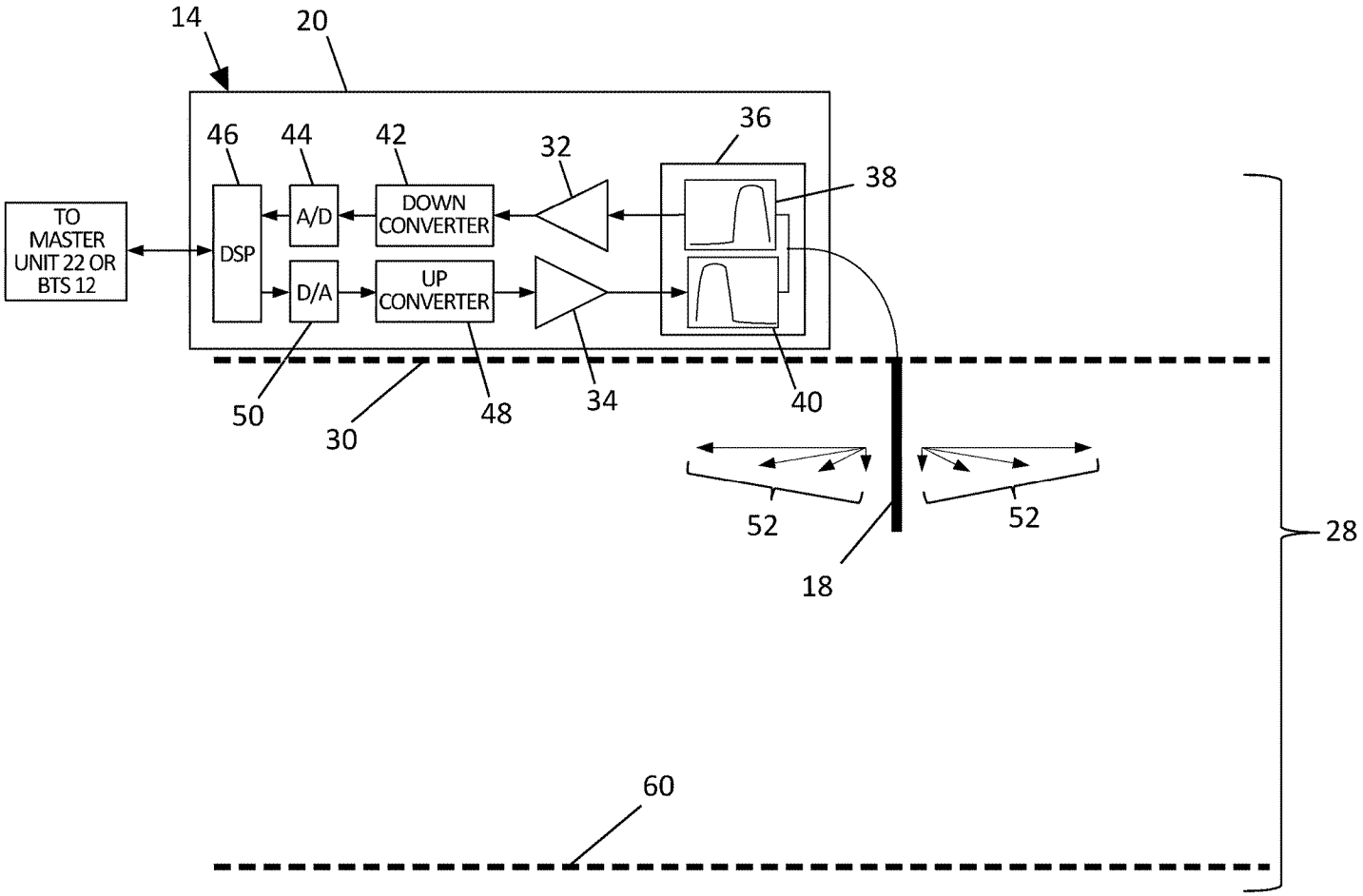
FIG. 2 PRIOR ART
FIG. 2 is a schematic diagram representation of a component of a prior art distributed antenna system similar to that of FIG. 1.

Remote antenna units 14 are generally coupled to one or more master units 22, which combine and process the signals from the remote antenna units 14 to interface appropriately with the BTS 12. Alternately, remote units 14 may be appropriately coupled directly to the BTS 12 in a remote radio head configuration as illustrated in the schematic diagram of FIG. 1A. A system controller 24 couples to and controls the operation of each of the master units 22 for handling and processing the uplink and downlink signals 26 associated with the remote antenna units 14. The signals 26 of the remote antenna units 14 are reflective of the uplink and downlink signals of the DAS 10 for communicating with UE devices 16. Such a DAS 10 may incorporate any number of remote antenna units and master units, and thus, would not be limited to the illustrated example shown in FIG. 1. When a distributed antenna system, such as DAS 10, is implemented in a building, the remote antenna units 14 may be positioned on a floor 28 of the building as illustrated in FIG. 2. For better coverage and aesthetics, the remote antenna unit 14 may be positioned at an elevated position on or near a ceiling. In one exemplary installation, only an antenna 18 extends below a drop ceiling 30 with the remaining electronics 20 located above the drop ceiling 30, as shown in FIG. 2.

Referring to FIG. 2, in contemporary remote units such as remote unit 14, the electronics may include a low noise amplifier 32 and a power amplifier 34 which are used to amplify the uplink and downlink signals received and transmitted on the antenna 18. These amplifiers 32, 34 are coupled to a duplexer 36, which combines the transmit and receive signals onto the antenna 18. The duplexer typically consists of two bandpass filters 38, 40. One of these filters 38 is tuned to a band of receive frequencies and the other filter 40 is tuned to a band of transmit frequencies. The low noise amplifier 32 is coupled to down converter circuitry 42 which in turn is coupled to an analog-to-digital (A/D) converter 44, which sends digital signals to a digital signal processor (DSP) 46. The DSP 46 may communicate with the base station 12 over a suitable high speed digital link. The power amplifier 34 is coupled to up converter circuitry 48 which receives signals from a digital-to-analog (D/A) converter 50, which receives digital signals from the DSP 46.

The antenna 18 provides the desired radiation pattern 52 to cover the single floor 28 of a building, for example. The RF radiation pattern 52 of antenna 18 is generally the strongest in the horizontal direction to assist in overcoming the typically large signal path loss to the user equipment 16 of distant users. Users located near the antenna typically have a much lower signal path loss. The RF radiation pattern 52 in the direction of users near or directly below the antenna should be much less. This pattern assists in reducing a dynamic range of signals received from both distant users and nearby users. The arrows illustrating the radiation pattern in FIG. 2 are generally relatively sized to illustrate the strength of the antenna pattern 52 in different directions.

Using a traditional duplexer 36 as illustrated in FIG. 2 limits the frequency band at which the remote transceiver 14 can operate. This is mostly due to the bandpass filters 38, 40 utilized in the duplexer. In order to operate at a different frequency band, the bandpass filters 38, 40 would need to be replaced or the remote transceiver would need to have multiple filters with the ability to switch between the sets of filters. This adds both cost and complexity to the transceiver. Therefore, using traditional remote transceivers in a DAS limits the flexibility of such a DAS.

In accordance with an aspect of the invention, a more flexible approach is provided that eliminates the duplexer 36, allowing the transceiver or remote unit to transmit and receive at any frequency within the tuning range of the local oscillators (10) at the remote unit. Low cost local oscillators are implemented that cover 400-5,000 MHz, which includes all current wireless bands. Eliminating the duplexer 36 provides advantages of expanded coverage over a larger frequency range when compared to a duplexer approach which only covers a limited band, such as 824-894 MHz band, as set forth in the example above.

Figure 3:
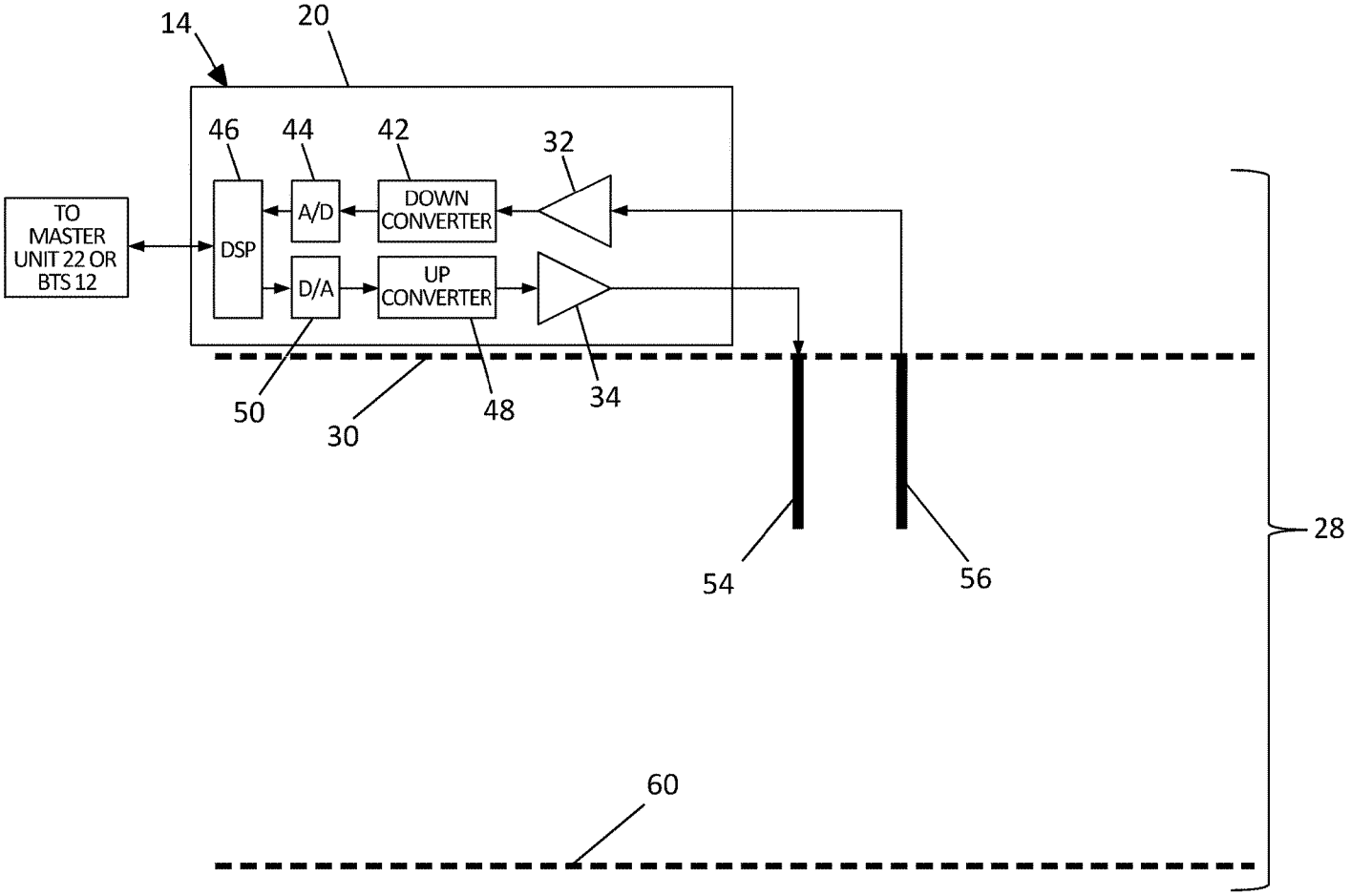
FIG. 3 is a schematic diagram representation of an exemplary non-duplexer remote antenna configuration of a DAS with separate transmit and receive antennas.

In order to eliminate the duplexer 36, separate transmit 54 and receive 56 antennas might be used as illustrated in FIG. 3. A challenge with this approach is achieving the needed isolation between the separate antennas 54, 56. For example, assuming that approximately 40 dB of isolation is needed between dipole antennas at about 700 MHz, the antennas 54, 56 would need to be approximately 18 feet apart if mounted next to each other as shown in FIG. 3 with no isolation structures between the antennas. This would, in effect, require the transceiver or remote unit 14 to be split into two separate remote units, thus driving up cost and potentially presenting an aesthetic problem when mounted.

In another aspect of the invention the isolation between the receive and transmit bands is also addressed. The duplexer 36 in FIG. 2 does more than just combine the signals to the common antenna 18. The filtering of the duplexer 36 is also an important aspect of its function in preventing the transmitter circuitry and signals from desensitizing the receiver circuitry. Transmitters generally transmit spurious products and an elevated noise floor that may occur at the band of the receive frequencies. The elevated noise and the spurious products interfere with and may potentially block the reception of desired signals coming from the user equipment 16. In order to eliminate the duplexer, the invention addresses the transmit/receive isolation that the duplexer would normally provide. Embodiments of the invention use two antennas arranged in a fashion such that the receive antenna 56 and transmit 54 antenna have isolation from each other but neither is isolated from the user equipment 16 located in the vicinity of the remote.

Figure 4:
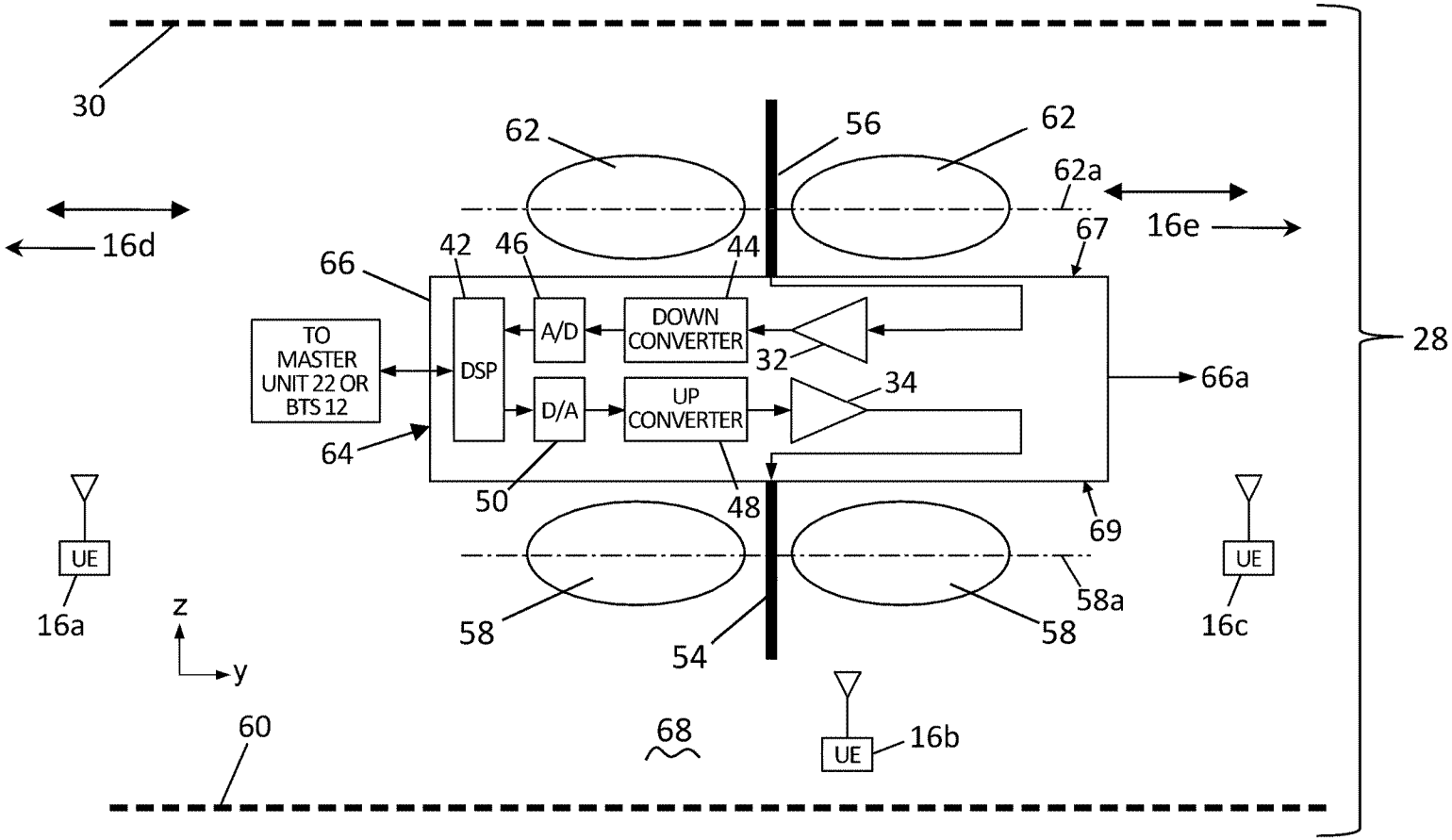
FIG. 4 is a schematic diagram representation of a broadband transceiver embodiment in accordance with the invention utilizing toroidal antenna patterns suitable for use in embodiments of the invention.
Figure 4B:
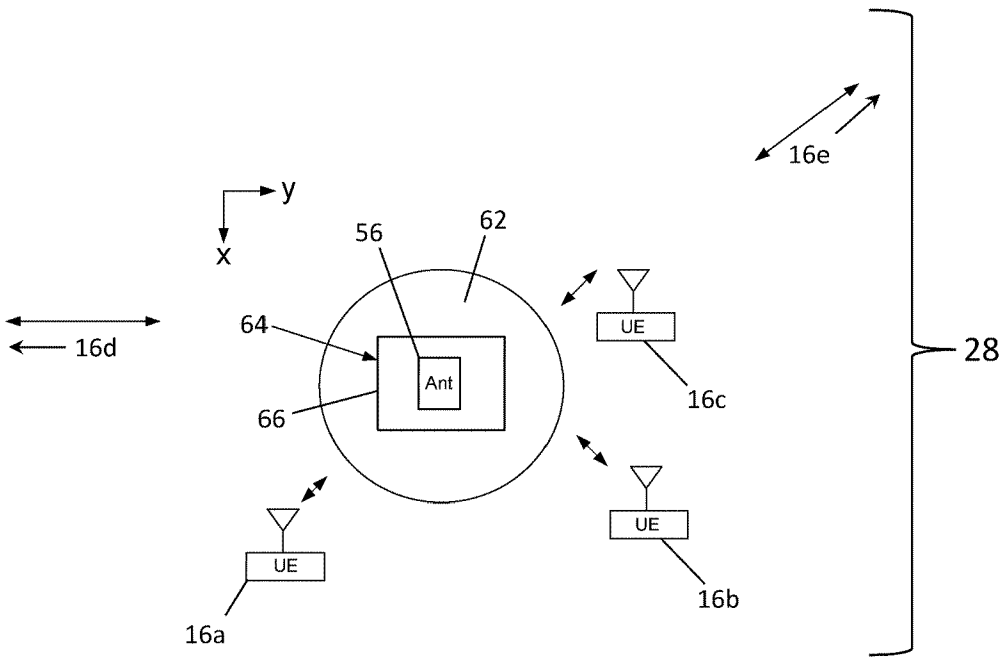
FIG. 4B is a schematic view of a broadband transceiver of the invention, as used in a DAS system.

FIG. 4 illustrates an embodiment of the present invention in the form of a broadband transceiver 64. In one possible use, the broadband transceiver may be utilized as a remote unit in a DAS system. The broadband transceiver 64 incorporates broadband transceiver circuitry that does not utilize a duplexer. Similar reference numerals are utilized for components in FIG. 4 that are discussed with respect to FIG. 3. The transceiver 64 incorporates separate transmit and receive antennas 54, 56 in a fashion to provide desired signal coverage as well as the necessary signal isolation within an integrated unit. In FIG. 4, the x-y plane or azimuth plane 58*a* of a generally toroidal antenna radiation pattern 58 for transmit antenna 54 is oriented substantially parallel to the floor surface 60 of an installation site, such as the floor 28 of a building. User equipment 16*a*-16*e*, such as mobile phones, may be located anywhere on the floor 28 of the building. Similarly, the x-y plane or azimuth plane 62*a* of a desirable antenna pattern 62 for the receive antenna 56 is also oriented substantially parallel to the floor surface 60. In one embodiment, the antennas are broadband planar monopole antennas.

In accordance with an aspect of the invention, the transceiver 64 provides the illustrated pattern orientation, wherein the gain of the antennas 54, 56 and the radiation patterns associated therewith are generally strongest in the direction of distant mobile user equipment 16*d*, 16*e*. More specifically, the radiation patterns 58, 62 are stronger in a direction parallel to a ceiling 30 or floor 60 compared to a direction perpendicular to the ceiling and floor: Such a feature of transceiver 64 assists in overcoming a high path loss between the distant user equipment 16*d*, 16*e* and the remote. The antenna patterns 58, 62 provided by the invention also assist in reducing antenna gain in the direction of the mobile user equipment 16*a*-*c* that is directly below the antennas 54 and 56 and transceiver 64. Signals to and from user equipment 16*a*-*c* are generally much stronger due to their proximity to the transceiver 64, and thus, tend to overload the receiver circuitry of the transceiver. Reducing the antenna gain directly below the transceiver assists in preventing the signal overload of the transceiver/remote unit 64. The antenna patterns shown in FIG. 4 are illustrated in the y-z elevation plane.

Figure 4A:
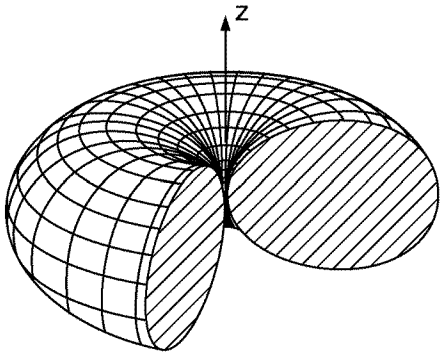
FIG. 4A is an illustrative view of toroidal radiation pattern of a broadband transceiver of the invention.

FIG. 4A is an illustration of the toroidal antenna pattern implemented in the transceiver 64 of the present invention to achieve the desired antenna isolation and transmit/receive signal isolation in a remote unit of a DAS system without the use of a duplexer in accordance with an aspect of the invention. As discussed below, transceiver 64 also implements a layer structure between the antennas 54, 56 that is substantially impermeable to RF radiation to further isolate the transmit and receive signals and antenna patterns. FIG.

4B is an azimuth view of the remote antenna unit 64 and user equipment 16*a-e* illustrated in FIG. 4, looking down from the ceiling 30 in the x-y plane.

In one embodiment of the invention, as illustrated in FIG. 4, receive antenna 56 and transmit antenna 54 are separated from each other by an RF impermeable layer 66. The RF impermeable layer structure is substantially impermeable to RF radiation to separate the transmit and receive signals and separate the antenna patterns 58, 62 as illustrated in FIG. 4. Layer structure 66 may be formed of any suitable material which is capable of blocking the RF radiation between the antennas 54 and 56. For example, layer structure 66 might be formed of a suitable metal, or alternatively, of a nonconductive material that is coated with a conductive material such as a metal. In one particular embodiment of the invention, layer structure 66 is provided by the transceiver housing, such as a metal enclosure, that is configured for housing the various electrical components of the transceiver 64. In that way, the antennas 54, 56 may be integrated into a single transceiver unit including housing 66, which is suitable for use as a remote unit within a DAS system.

For example, housing 66 might be configured in the form of a planar or box-like housing structure that generally extends in a plane 66A that is generally perpendicular to the antennas 54 and 56, and generally parallel to the azimuth planes 58A and 62A defined by the transmit/receive antenna patterns 58, 62. Alternately, opposite sides of the housing could have a non-planar shape, such as curved, wavy, or conical. The housing or enclosure 66 assists in providing isolation between the transmit 54 and receive 56 antennas. Based on the orientation of the antennas 54, 56, and housing or layer structure 66, the housing does not prevent either antenna from providing the proper coverage for the desired area. The transmit radiation pattern 58 of the transmit antenna 54 is minimally affected by the housing 66. The receive radiation pattern 62 of the receive antenna 56 however may be partially blocked or shadowed by the housing 66. For example, when transceiver 64 is mounted in an enclosure having a ceiling, such as by being suspended from or located close to the ceiling 30 as illustrated in FIG. 4, the layer/housing 66 will block at least a portion of the receive antenna pattern 62. In accordance with another aspect of the invention, such blockage or attenuation provided by the unique transceiver 64 of the invention provides desirable signal handling features with respect to the receive signals from user equipment located closely to the transceiver 64. Weaker signals from distant user equipment 16*d*, 16*e* would typically arrive almost horizontally to the receive antenna 56. Therefore, the layer housing 66 will generally have little or no effect on those weaker signals. However, the blocked or shadowed area 68 under the housing 66 reduces the receive signal strength from user equipment units 16*a*, 16*b*, 16*c* directly under or very near the receive antenna 56 of the transceiver 64. This will assist in preventing those close user equipment units from overwhelming the receiver circuitry of the transceiver.

Furthermore, the invention provides improvements in the dynamic range and functionality of the receiver circuitry of transceiver 64. Designing receivers to have enough dynamic range to handle the largest and smallest level signals simultaneously is generally difficult and can be costly. The present invention solves such problems. The shadowing of the receive antenna by the transceiver in the service area of the invention assists in reducing the dynamic range required of the receiver circuitry of transceiver 64.

Figure 4C:
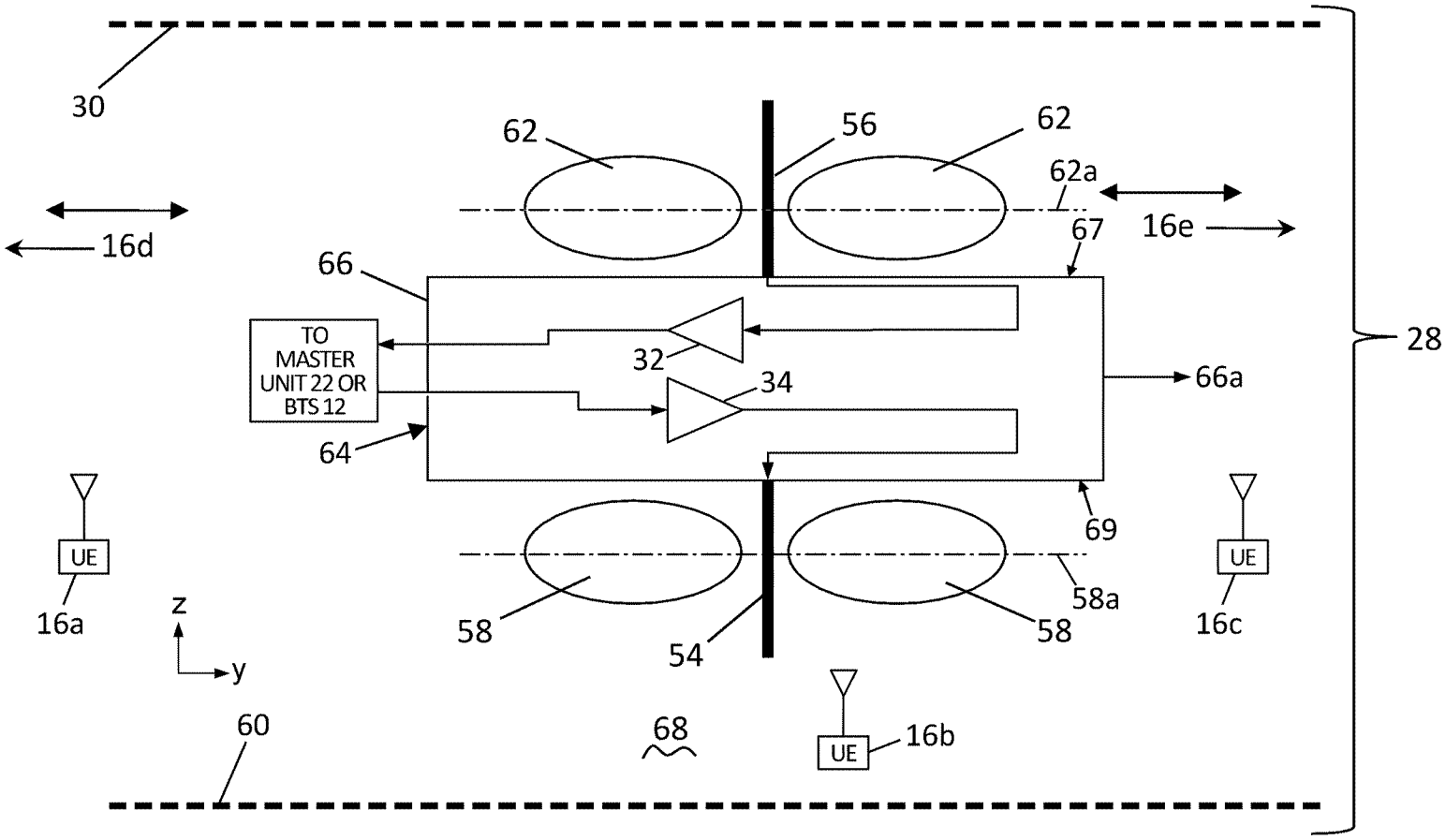
FIG. 4C is a schematic view of a broadband transceiver of the invention, utilizing analog transmissions.
Figure 4D:
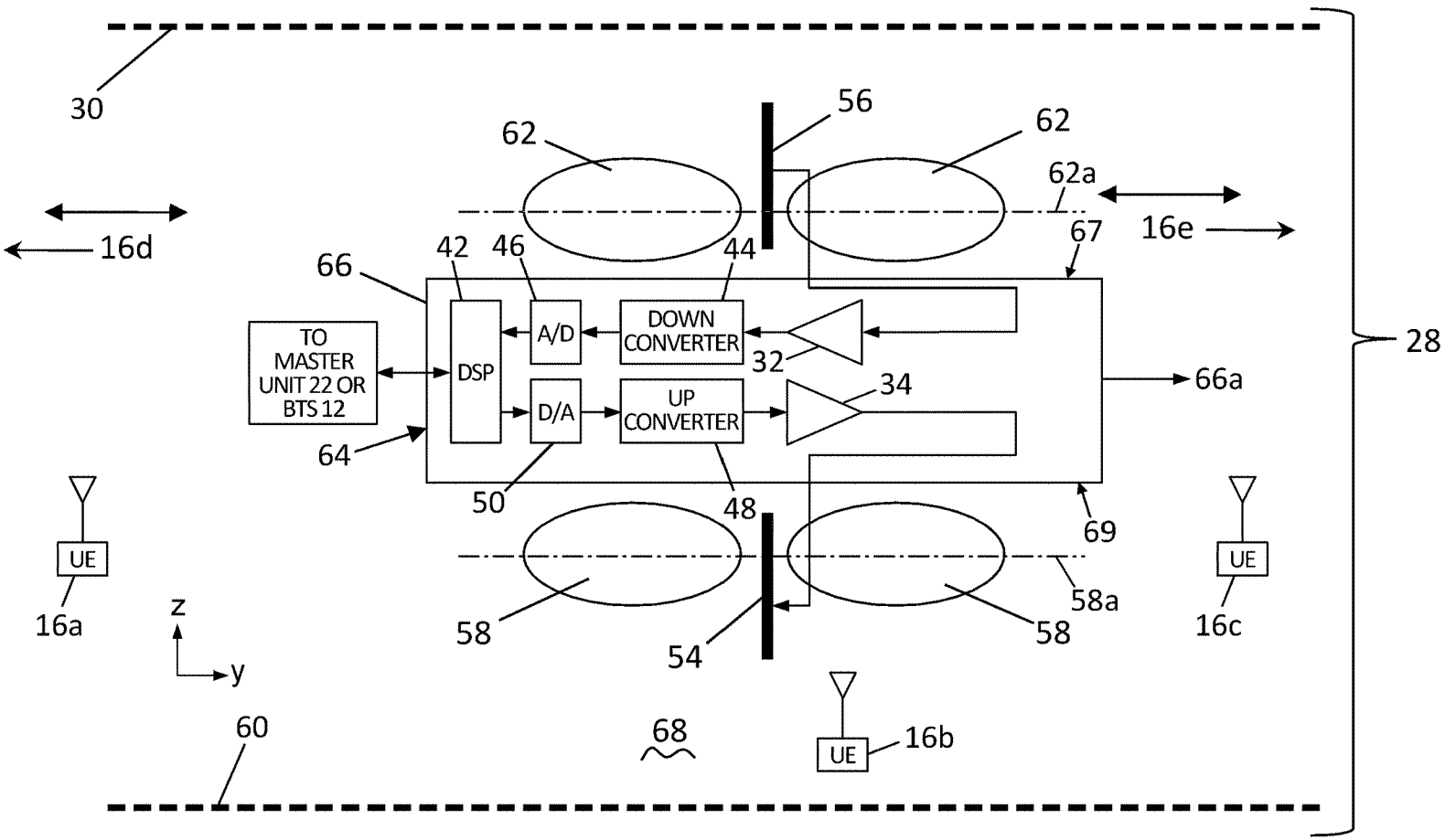
FIG. 4D is a schematic view of an alternate antenna configuration for a broadband transceiver of the invention.
Figure 7:
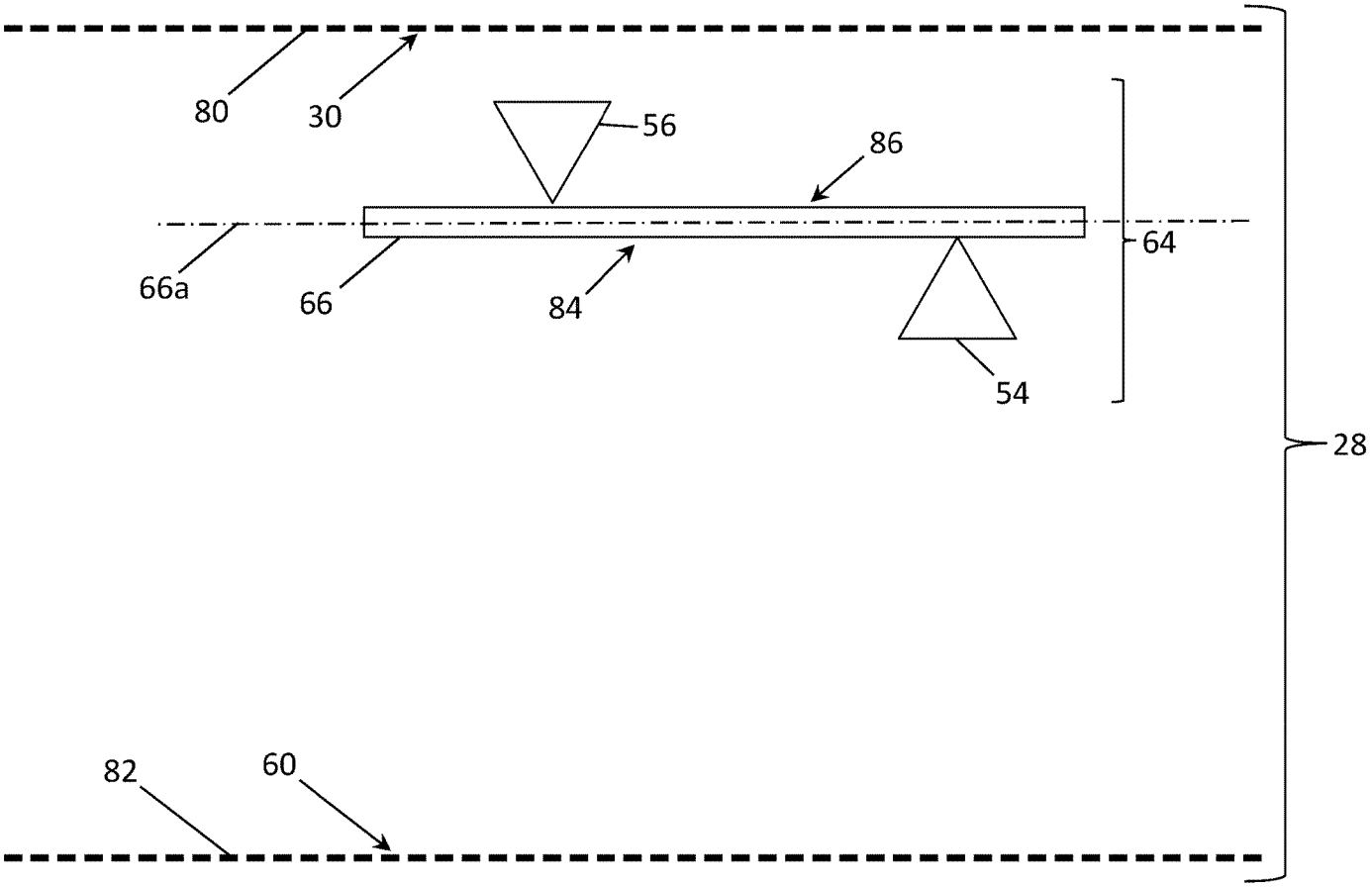
FIG. 7 is a schematic diagram representation of another exemplary embodiment of the invention.

In an alternate embodiment of FIG. 4, illustrated by the schematic diagram of FIG. 4C, the uplink and down link converters 44 and 48, as well as the components used for digital communications 42, 46, and 50 with either the master unit 22 or BTS 12 may be eliminated. In this embodiment, communications with either the master unit 22 or BTS 12 are achieved with analog transmissions over an appropriate communications medium such as copper wire. Moreover, dipole, rather than monopole antennas (as illustrated in FIG. 4) may be used with the embodiments of FIG. 4 as illustrated in the schematic diagram of FIG. 4D. In this particular embodiment, antennas 54 and 56 are mounted spaced from their corresponding face surface 67 and 69. Other types of antennas, such as an inverted cone (FIG. 7) or antennas able to generate toroidal patterns, may also be used with embodiments of the invention.

Figure 5:
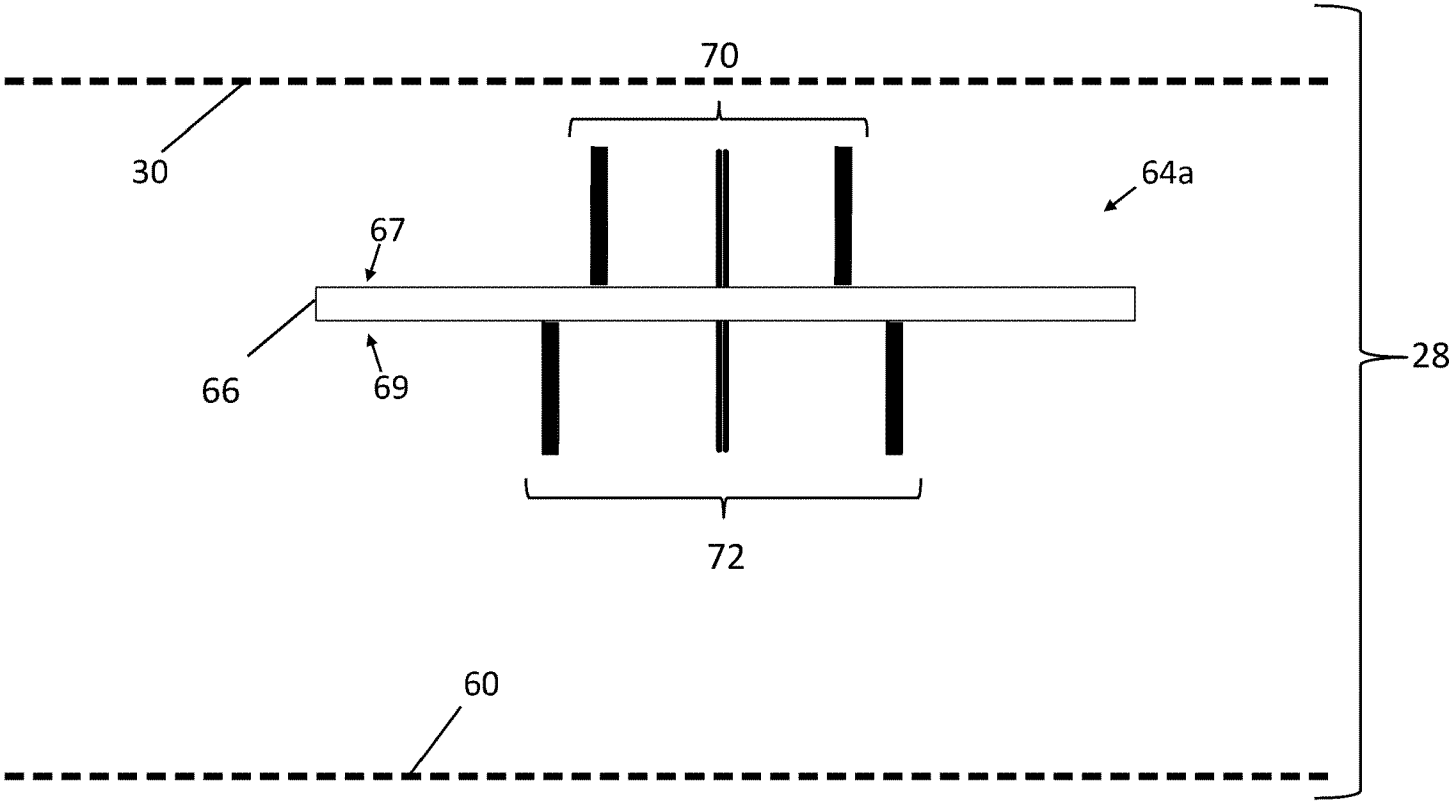
FIG. 5 is a schematic diagram representation of an embodiment of the invention with multiple transmit and receive antennas.

In addition to alternate types of antennas, in an alternate embodiment of the invention, the transceiver 64*a* may include multiple receive antennas 70 above the layer/housing 66 and multiple transmit antennas 72 below layer/housing 66 as seen in FIG. 5. Other embodiments of the invention may include additional antenna configurations including multiple receive or transmit antennas on one side and a single receive or transmit antenna on the opposite side as well as other numbers of antennas on the transmit and receive sides of the remote unit for achieving the features of the invention. These multiple antenna configurations may employ MIMO or other diversity schemes.

Figure 6:
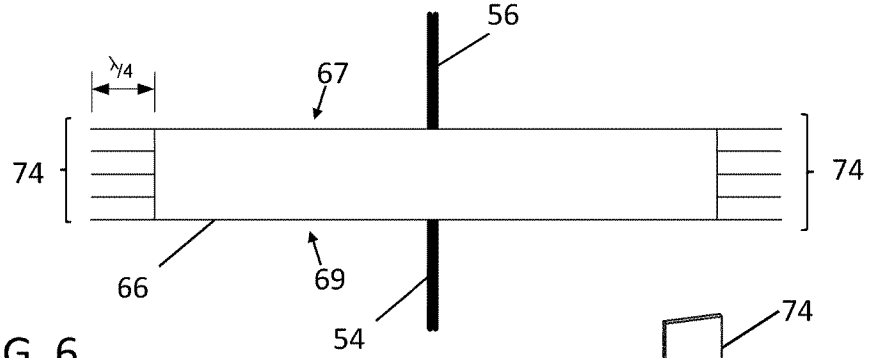
FIG. 6 is a schematic diagram representation of another embodiment of the invention utilizing RF chokes.

For further isolation, one embodiment of the transceiver 66 utilizes RF chokes incorporated into layer structure or housing 66 to assist in enhancing the isolation between the transmit 54 and receive antennas 56 as seen in FIG. 6. In the embodiment of FIG. 6, the RF chokes 74 are configured in the form of a plurality of fin structures positioned around the perimeter of the layer structure or housing 66. The fins may be a quarter of a wavelength deep in dimension, for example, for attenuating RF signals. In other embodiments, where the structure may have multiple wave lengths, some other suitable or equivalent measure may be used, i.e., a combined effect which would be equivalent to a quarter wavelength acting as an RF choke. The chokes 74 assist in reducing or "choking" out currents which would otherwise flow between the sides of face surfaces 67, 69 of the layer structure/housing 66. These currents would otherwise reduce isolation between the antennas 54, 56. The schematic view of FIG. 6 illustrates the chokes 74 on the ends of the layer structure/housing 66. In other embodiments, the chokes 74 may be positioned around the perimeter or on all sides of the layer structure/housing 66 between the transmit 54*a*, 54*b* and receive 56*a*, 56*b* antennas.

Figure 6A:
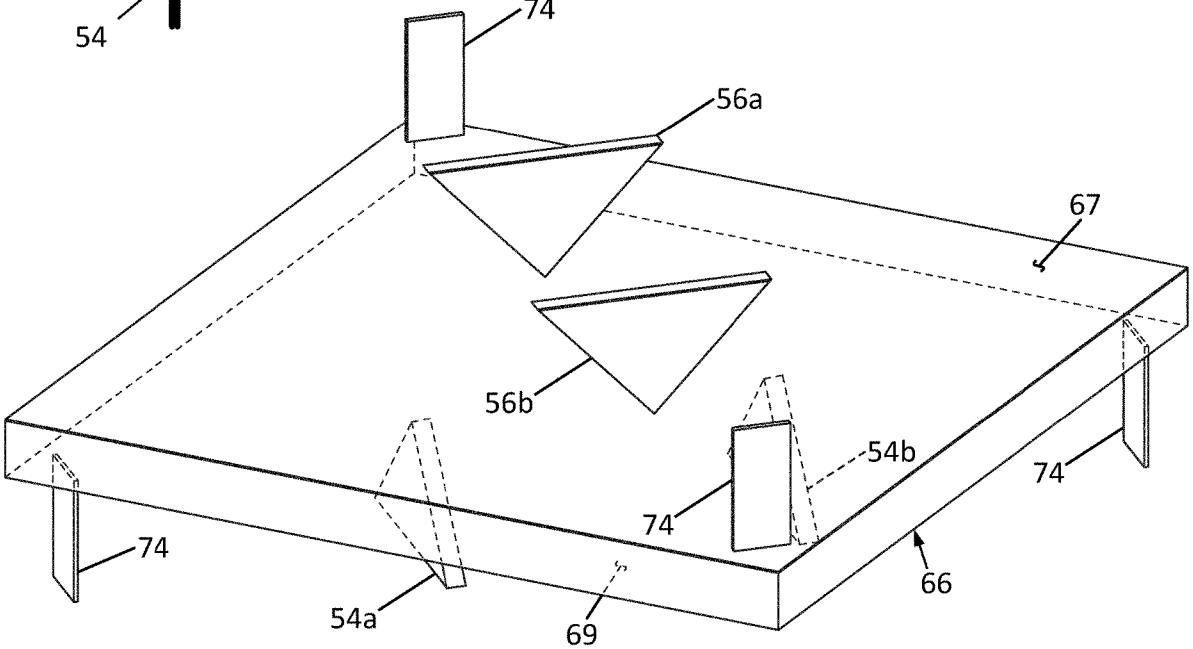
FIG. 6A is a schematic diagram representation of an alternate embodiment similar to the using RF chokes similar to FIG. 6.

In alternate embodiment as illustrated in FIG. 6A, the RF chokes 74 may also be extend substantially perpendicular from the face surfaces 67, 69. In this embodiment, the transmit 54*a*, 54*b* and receive 56*a*, 56*b* antennas are configured as bow-tie monopole antennas. This particular embodiment contains two transmit antennas 54*a*, 54*b* and two receive antennas 56*a*, 54*b*, though more or fewer antennas may be used for either the transmit or receive sides of the broadband transceiver. The receive antennas 56*a*, 56*b* are positioned in line with each other on the face surface 67 such that a plane of one of the antennas 56*a*, 56*b* is substantially parallel to a plane of the other antenna.

Parasitic posts acting as chokes 74 are also positioned on the face surface 67 near the corners and in line with the bow-tie monopole antennas with a plane of the chokes 74 also being substantially parallel to the planes of the antennas 56*a*, 56*b*. The configuration for the transmit antennas 54*a*, 5*b* and corresponding chokes 74 is similar to the receive antennas 56*a*, 56*b*, however the transmit antennas 54*a*, 54*b* and parasitic posts acting as chokes 74 are rotated about 90 degrees from that of the receive antenna configuration as illustrated in FIG. 6A. The positioning of the chokes at the corners of the face surfaces 67, 69 oriented such that their planes are substantially parallel to the planes of the antennas as well as the approximate 90 degree relative rotation in the antennas and chokes between the transmit and receive portions of the broadband transceiver assist in reducing RF interference between the transmit 54*a*, 54*b* and receive 56*a*, 56*b* antennas. Embodiments utilizing the multiple antennas for receive and transmit, such as the embodiment of FIG. 6A having multiple bow-tie antennas 54*a*, 54*b*, 56*a*, 56*b* and RF chokes 74, may be used to employ MIMO or other diversity schemes for signal processing and improved channel capacity at higher signal-to-noise ratios (S/N). As noted, the invention is not limited to schemes involving two receive or transmit antennas and a greater number of antennas might be utilized, such as for MIMO schemes.

Embodiments of the invention, such as those in FIGS. 4-6 provide a broadband transceiver capable of receiving and transmitting signals anywhere in a range of approximately 400 MHz to approximately 2.7 GHz. This broad response range is facilitated by eliminating the duplexer found in traditional transceiver designs. Instead of relying on a duplexer to achieve high isolation between the transmit antenna 54 and the receive antenna 56, embodiments of the invention rely on an RF impermeable layer structure (such as housing 66) that shields the receive antenna 56 from the RF transmissions emitted from the transmit antenna 54. Additionally, the transmit and receive antennas 54, 56 are configured to produce a generally toroidal RF radiation pattern that is substantially parallel with the plane defined by the RF impermeable layer structure in some embodiments. The toroidal antenna pattern for each antenna is stronger in a direction substantially parallel to the respective face surfaces 67, 69 compared to a direction substantially perpendicular to the respective face surfaces. In this embodiment, MIMO processing may also be employed to assist in increasing channel capacity at higher signal-to-noise ratios (S/N) though other embodiments may employ other diversity schemes.

As illustrated in the Figures, the layer structure 66 is substantially impermeable to RF radiation and includes opposing face surfaces 67, 69 that are generally opposite each other. In illustrated embodiments, the antennas 54, 56 are mounted on or spaced from the respective face surfaces 69, 67 of the layer structure 66. Each of the antennas generates a generally toroidal radiation pattern that is stronger or has a higher signal level in a direction that is substantially parallel to the respective face surface compared to the direction that is substantially perpendicular to the face surface. In one embodiment of the invention, each of the antennas 54, 56 generates a similar toroidal radiation pattern as illustrated in FIG. 4. In one particular embodiment illustrated in FIG. 7, the transceiver 64, such as in the form of a remote antenna unit of a DAS, is illustrated mounted within a room or other enclosure. The plane 66*a* of the RF impermeable layer 66 is positioned essentially parallel with a plane defined by the ceiling surface 80 and a plane defined by the floor surface 82. The transceiver 66 is spaced from both the ceiling surface 80 and the floor surface 82. The transceiver or remote antenna unit 64 may be mounted directly to the ceiling surface or to another structure of the enclosure to be positioned, elevated and proximate ceiling surface 80.

In one preferable mounting arrangement, the transmitter side 84 of the RF impermeable layer 66 faces the floor 60, and the receiver side 86 of the RF impermeable layer 66 faces the ceiling 30. In such a configuration, the RF impermeable layer structure 66 assists in shielding the receive antenna 56 from the RF transmissions emitted from the transmit antenna 54; however, the RF impermeable layer structure 66 does not significantly shield transmissions received by the receive antenna 56 from user equipment (16*a*-*e*). Such receive signals are received from directions substantially parallel with the plane 66*a* of the RF impermeable layer structure 66 and are, therefore, not significantly blocked by transceiver 64 and layer structure 66. Alternately, the impermeable layer structure 66 may be mounted essentially parallel with a plane formed by a wall or other vertical structure, such as a wall in an elevator shaft or stairwell. In this orientation, the antenna pattern will be a generally toroidal radiation pattern that is stronger in a direction that is substantially parallel to the respective face surface compared to the direction that is substantially perpendicular to the face surface, and thus will have a stronger substantially vertical orientation.

In some embodiments, the RF impermeable layer structure may be constructed as an RF impermeable housing in which the transceiver electronic components are housed (see FIG. 4). In other embodiments, the RF impermeable layer 66 may be constructed as a printed circuit board (PCB) with an RF impermeable coating on at least one side. In such embodiments, the PCB and related circuitry may then be housed within a housing that is not RF impermeable. Some embodiments of the RF impermeable layer may contain two impermeable layers with the transceiver circuitry housed between the impermeable layers. In still other embodiments of the RF impermeable layer structure 66, an RF impermeable plate may be mounted to an outer surface of a housing and in other embodiments an RF impermeable plate may be mounted to an inner surface of a housing. Accordingly, layer structure 66 is not limited to a particular construction, as long as layer structure 66 has the RF impermeable features are discussed herein for isolating the antennas 54, 56.

The RF impermeable layer structure 66 may be formed of any substance that does not allow RF energy to radiate through the layer, such as a metal or some other highly conductive material. Alternatively, a substance that absorbs or blocks RF energy may be used to form layer 66. Embodiments of the RF impermeable layer may include multiple layers of different materials. In one embodiment, the RF impermeable layer(s), or housing, may include a high impedance, or lossy, surface that resists the propagation of surface waves. Such a high impedance or lossy surface may be created by one or more features, including having a rough layer or housing surface, applying a coating layer containing a poorly conducting or high impedance material, and/or adhering a layer of a material to a surface of the RF impermeable layer structure or a combination of those. The adhered layer of material may include a material that has a high impedance and reduces the conductivity (i.e., makes more lossy) of the surface of the RF impermeable layer structure 66.

Figure 8:
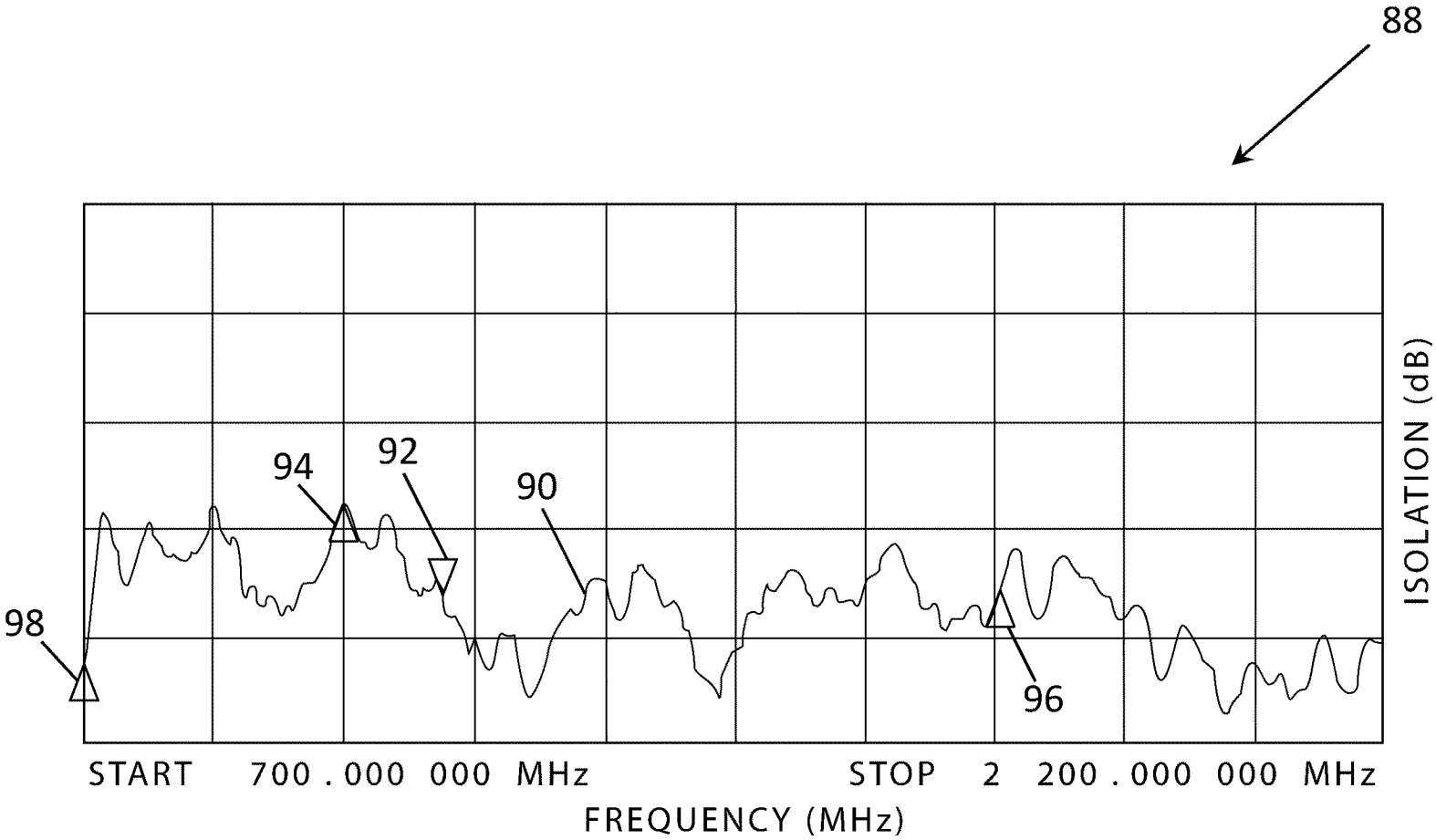
FIG. 8 is a graph of isolation data between a transmit antenna and a receive antenna in accordance with the invention.

FIG. 8 is a graph 88 of isolation data taken from a transmit antenna to a receive antenna in an exemplary embodiment of a transceiver of the invention. In this particular embodiment, the embodiment included a horizontal 14×14 inch housing with two RF chokes around the perimeter, a receive antenna on the top surface and a transmit antenna on the bottom surface, the housing was 3 inches thick and separated the antennas by about 3 inches. The antennas were configured as broadband planar monopoles. Measurements were performed in a screen room where reflections provided a worst case scenario. The measurement covers a range of approximately 700 MHz to approximately 2200 MHz. As can be seen on curve 90 in the graph 88 in FIG. 8, the isolation was greater than 30 dB over almost the entire band. For example, at point 92, which corresponds to approximately 1.113 GHz, the isolation is about −36.2 dB. At point 94, which corresponds to approximately 1.0 GHz, the isolation is about −27.8 dB. At point 96, which corresponds to approximately 1.76 GHz, the isolation is about −35.7 dB. And at point 98, which corresponds to 700 MHz, the isolation is about 42.5 dB. Generally, antennas this close together without the RF isolation and chokes between them would normally have less than 10 dB isolation.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A broadband transceiver, comprising:

at least one layer structure that is substantially impermeable to RF radiation, the at least one layer structure including a first face surface substantially opposite a second face surface;

at least one dedicated receive antenna located proximate the first face surface and configured to receive RF transmissions; and at least one dedicated transmit antenna located proximate the second face surface and configured to transmit RF transmissions by generating a generally toroidal radiation pattern that is stronger in a first direction that is substantially parallel to the second face surface compared to a second direction that is substantially perpendicular to the second face surface;

wherein the at least one layer structure provides isolation between the at least one dedicated receive antenna and the at least one dedicated transmit antenna that is necessary for simultaneous transmission and reception of the RF transmissions with a user device;

wherein the broadband transceiver is configured to simultaneously transmit and receive RF transmissions with the user device without needing additional elements other than the at least one layer structure to provide the isolation between the at least one dedicated receive antenna and the at least one dedicated transmit antenna; and wherein the broadband transceiver is configured to transmit RF transmissions using the at least one dedicated transmit antenna, wherein the broadband transceiver is configured to receive RF transmissions using the at least one dedicated receive antenna.

2. The broadband transceiver of claim 1, further comprising:

a low noise amplifier configured to amplify analog communication signals received by the at least one dedicated receive antenna prior to transmitting the analog signals to the user device; and a power amplifier configured to amplify analog communication signals received from the user device prior to transmitting the analog signals over the at least one dedicated transmit antenna.

3. The broadband transceiver of claim 1, further comprising:

a digital signal processor configured to interface with a device;

a transmitter circuit configured to transmit downlink communication signals for radiation by the at least one dedicated transmit antenna, the digital signal processor being configured for receiving the downlink communication signals from the device; and a receiver circuit configured to transmit uplink communication signals detected by the at least one dedicated receive antenna to the device via the digital signal processor.

4. The broadband transceiver of claim 3, wherein the digital signal processor is configured to communicate with the device over an interface selected from a group consisting of: an optical fiber communication interface, a waveguide, an electrical cable communication interface, a free-space laser link, and combinations thereof.

5. The broadband transceiver of claim 3, wherein the transmitter circuit comprises:

a digital to analog converter configured to receive the downlink communication signals from the digital signal processor and convert the downlink communication signals from digital to analog form;

up-converter circuitry configured to convert a frequency of the downlink communication signals from an intermediate frequency to a frequency for transmission over the at least one dedicated transmit antenna; and a power amplifier configured to amplify the up-converted communication signals prior to transmitting over the at least one dedicated transmit antenna.

6. The broadband transceiver of claim 3, wherein the receiver circuit comprises:

a low noise amplifier configured to amplify the uplink communication signals received from the at least one dedicated receive antenna;

down-converter circuitry configured to convert a frequency of the uplink communication signals from a receive frequency to an intermediate frequency; and an analog to digital converter configured to convert the down-converted uplink communication signals from analog to digital and for use by the digital signal processor.

7. The broadband transceiver of claim 1, wherein at least one of the at least one dedicated receive antenna and the at least one dedicated transmit antenna is selected from a group consisting of a broadband monopole antenna, a dipole antenna, an inverted cone antenna, a bow-tie monopole antenna, and combinations thereof.

8. The broadband transceiver of claim 1, wherein the RF impermeable layer structure is configured for being oriented in a space in a substantially vertical orientation with respect to a floor for the at least one dedicated transmit antenna to generate the generally toroidal radiation pattern that is stronger in a vertical direction compared to a horizontal direction.

9. The broadband transceiver of claim 1, wherein the RF impermeable layer structure is configured for being oriented in a space in a substantially horizontal orientation with respect to a floor for the at least one dedicated transmit antenna to generate the generally toroidal radiation pattern that is stronger in a horizontal direction compared to a vertical direction.

10. The broadband transceiver of claim 9, wherein the at least one dedicated transmit antenna is positioned between the floor and the at least one dedicated receive antenna.

11. The broadband transceiver of claim 1, wherein the broadband transceiver is configured for being mounted in a space having a ceiling surface and a floor surface, the RF impermeable layer structure being oriented such that the first face surface with the at least one dedicated receive antenna is spaced from and facing the ceiling surface and the second face surface with the at least one dedicated transmit antenna is spaced from and facing the floor surface.

12. The broadband transceiver of claim 11, wherein the broadband transceiver is configured for being mounted in the space and elevated with respect to the floor surface.

13. The broadband transceiver of claim 1, wherein a plurality of receive antennas are located on the first face surface.

14. The broadband transceiver of claim 1, wherein a plurality of transmit antennas are located on the second face surface.

15. The broadband transceiver of claim 1, wherein the at least one layer structure includes an RF choke positioned on the layer structure between the first face surface and the second face surface.

16. The broadband transceiver of claim 1, wherein the at least one dedicated receive antenna is configured as a bow-tie monopole antenna, the broadband transceiver further comprising:

at least one RF choke extending substantially perpendicular from the first face surface, wherein the at least one RF choke is positioned in line with the at least one dedicated receive antenna, and wherein a plane of the at least one RF choke is substantially parallel to a plane of the at least one dedicated receive antenna.

17. The broadband transceiver of claim 16, wherein the at least one dedicated transmit antenna is configured as a bow-tie monopole antenna, the broadband transceiver further comprising:

at least one RF choke extending substantially perpendicular from the second face surface, wherein the at least one RF choke is positioned in line with the at least one dedicated transmit antenna, wherein a plane of the at least one RF choke is substantially parallel to a plane of the at least one dedicated transmit antenna, and wherein the at least one dedicated transmit antenna and the at least one RF choke on the second face surface are rotated approximately ninety degrees from that of the at least one dedicated receive antenna and the at least one RF choke on the first face surface.

18. The broadband transceiver of claim 1, wherein the at least one layer structure includes at least one high impedance surface for resisting a propagation of surface waves, the at least one high impedance surface including a rough layer, a coating layer of high impedance material or an adhered layer of high impedance material.

19. A system comprising:

at least one of a master unit or a base transceiver station configured for transceiving communication signals;

at least one remote unit for transceiving communication signals with the master unit or base transceiver station and communicating with one or more user devices, the remote unit including a broadband transceiver comprising:

at least one layer structure that is substantially impermeable to RF radiation, the at least one layer structure including a first face surface substantially opposite a second face surface;

a dedicated receive antenna located proximate the first face surface and configured to receive RF transmissions; and a dedicated transmit antenna located proximate the second face surface and configured to transmit RF transmissions by generating a generally toroidal radiation pattern that is stronger in a direction substantially parallel to the second face surface compared to a direction substantially perpendicular to the second face surface;

wherein the at least one layer structure provides isolation between the at least one dedicated receive antenna and the at least one dedicated transmit antenna that is necessary for simultaneous transmission and reception of the RF transmissions with a user device;

wherein the broadband transceiver is configured to simultaneously transmit and receive RF transmissions with the user device without needing additional elements other than the at least one layer structure to provide the isolation between the at least one dedicated receive antenna and the at least one dedicated transmit antenna; and wherein the broadband transceiver is configured to transmit RF transmissions using the dedicated transmit antenna, wherein the broadband transceiver is configured to receive RF transmissions using the dedicated receive antenna.

20. The system of claim 19, the broadband transceiver further comprising:

a digital signal processor configured to interface with the master unit;

a transmitter circuit configured to transmit downlink communication signals for radiation by the dedicated transmit antenna, the digital signal processor being configured for receiving the downlink communication signals from the master unit; and a receiver circuit configured to transmit uplink communication signals detected by the dedicated receive antenna to the master unit via the digital signal processor.

21. The system of claim 20, wherein the digital signal processor is configured to communicate with the master unit over an interface selected from a group consisting of: an optical fiber communication interface, a waveguide, an electrical cable communication interface, a free-space laser link, and combinations thereof.

22. The system of claim 20, wherein the transmitter circuit comprises:

a digital to analog converter configured to receive the downlink communication signals from the digital signal processor and convert the downlink communication signals from digital to analog form;

up-converter circuitry configured to convert a frequency of the downlink communication signals from an intermediate frequency to a frequency for transmission over the dedicated transmit antenna; and a power amplifier configured to amplify the up-converted communication signals prior to transmitting over the dedicated transmit antenna.

23. The system of claim 20, wherein the receiver circuit comprises:

a low noise amplifier configured to amplify the uplink communication signals received from the dedicated receive antenna;

down-converter circuitry configured to convert a frequency of the uplink communication signals from a receive frequency to an intermediate frequency; and an analog to digital converter configured to convert the down-converted uplink communication signals from analog to digital and for use by the digital signal processor.

24. The system of claim 19, wherein at least one of the dedicated receive antenna or the dedicated transmit antenna is a broadband monopole antenna.

25. The system of claim 19, wherein a plurality of receive antennas are located on the first face surface and a plurality of transmit antennas are located on the second face surface.

26. The system of claim 19, wherein the at least one layer structure includes an RF choke positioned on the layer structure between the first face surface and the second face surface.

27. The system of claim 19, wherein the dedicated receive antenna is configured as a bow-tie monopole antenna, the system further comprising:

at least one RF choke extending substantially perpendicular from the first face surface, wherein the at least one RF choke is positioned in line with the dedicated receive antenna, and wherein a plane of the at least one RF choke is substantially parallel to a plane of the dedicated receive antenna.

28. The system of claim 27, wherein the dedicated transmit antenna is configured as a bow-tie monopole antenna, the system further comprising:

at least one RF choke extending substantially perpendicular from the second face surface, wherein the at least one RF choke is positioned in line with the dedicated transmit antenna, wherein a plane of the at least one RF choke is substantially parallel to a plane of the dedicated transmit antenna, and wherein the dedicated transmit antenna and the at least one RF choke on the second face surface are rotated approximately ninety degrees from that of the dedicated receive antenna and the at least one RF choke on the first face surface.

29. The system of claim 19, wherein the at least one layer structure includes at least one high impedance surface for resisting propagation of surface waves.

30. A method of performing broadband communications, comprising:

transmitting a downlink RF signal from a dedicated transmit antenna located proximate a first face surface of a broadband transceiver by generating a generally toroidal radiation pattern that is stronger in a first direction that is substantially parallel to the first face surface compared to a second direction that is substantially perpendicular to the first face surface;

receiving an uplink RF signal by a dedicated receive antenna located proximate a second face surface of the broadband transceiver;

isolating the dedicated receive antenna from the downlink RF signal transmitted from the dedicated transmit antenna with a layer structure that is substantially impermeable to RF radiation, the first face surface being located on an opposite side of the layer structure to the second face surface, the isolation necessary for simultaneous transmission and reception of the RF transmissions with a user device;

simultaneously transmitting and receiving, by the broadband transceiver, RF transmissions with the user device without needing additional elements other than the at least one layer structure to provide the isolation between the at least one dedicated receive antenna and the at least one dedicated transmit antenna; and wherein transmitting RF transmissions occurs via the dedicated transmit antenna, wherein receiving RF transmissions occurs via the dedicated receive antenna.

31. The method of claim 30, further comprising reducing currents flowing from one side of the RF impermeable layer structure to the other side of the RF impermeable layer using an RF choke.

32. The method of claim 30 further comprising mounting the broadband transceiver in a space having a ceiling surface and a floor surface, the RF impermeable layer structure being oriented such that the side with the dedicated receive antenna is spaced from and facing the ceiling surface and the side with the dedicated transmit antenna is spaced from and facing the floor surface.

33. The method of claim 32, wherein the broadband transceiver is configured for being mounted in the space and elevated with respect to the floor surface.

34. The method of claim 30, wherein at least one of the dedicated receive antenna and the dedicated transmit antenna is a broadband monopole antenna.

35. The broadband transceiver of claim 1, wherein the dedicated receive antenna is adapted to have a generally toroidal receiving pattern that is stronger in the first direction that is substantially parallel to the first face surface compared to the second direction that is substantially perpendicular to the first face surface.

36. The broadband transceiver of claim 1, wherein the broadband transceiver is in a remote unit of a distributed antenna system that includes a master unit or a base transceiver station configured for transceiving communication signals, wherein the remote unit is configured for transceiving the communication signals with the master unit and for communicating with one or more user devices.

37. The system of claim 19, wherein the dedicated receive antenna is adapted to have a generally toroidal receiving pattern that is stronger in the first direction that is substantially parallel to the first face surface compared to the second direction that is substantially perpendicular to the first face surface.

38. The method of claim 30, wherein receiving the uplink RF signal by the dedicated receive antenna includes receiving by a generally toroidal receiving pattern that is stronger in the first direction that is substantially parallel to the second face surface compared to the second direction that is substantially perpendicular to the second face surface.

39. The method of claim 30, wherein the broadband transceiver is in a remote unit of a distributed antenna system that includes a master unit or a base transceiver station transceiving communication signals with the remote unit that communicates with one or more user devices.

40. The broadband transceiver of claim 1, wherein the broadband transceiver does not include the additional elements.

41. The broadband transceiver of claim 1, wherein the additional elements include at least one of a filter, a duplexer, and a circulator.

42. The broadband transceiver of claim 1, wherein the broadband transceiver does not include at least one of a filter, a duplexer, and a circulator.

43. The broadband transceiver of claim 2, wherein the low noise amplifier is directly connected to the at least one dedicated receive antenna; and wherein the power amplifier is directly connected to the at least one dedicated transmit antenna.

44. The system of claim 19, wherein the broadband transceiver does not include the additional elements.

45. The system of claim 19, wherein the additional elements include at least one of a filter, a duplexer, and a circulator.

46. The system of claim 19, wherein the broadband transceiver does not include at least one of a filter, a duplexer, and a circulator.

47. The system of claim 19, further comprising:

a low noise amplifier directly connected to the at least one dedicated receive antenna and configured to amplify analog communication signals received by the at least one dedicated receive antenna prior to transmitting the analog signals to the user device; and a power amplifier directly connected to the at least one dedicated transmit antenna and configured to amplify analog communication signals received from the user device prior to transmitting the analog signals over the at least one dedicated transmit antenna.

48. The method of claim 30, wherein the additional elements include at least one of a filter, a duplexer, and a circulator.

* * * * *